United States Patent [19]

Gallo et al.

[11] Patent Number: 4,971,899

[45] Date of Patent: Nov. 20, 1990

[54] DIRECT POSITIVE FILMS

[75] Inventors: Steven R. Gallo, Roselle Park; John Abbruzzese, North Plainfield; Adelberto Aguero, West New York, all of N.J.

[73] Assignee: Sun Chemical Corporation, Fort Lee, N.J.

[21] Appl. No.: 347,761

[22] Filed: May 5, 1989

[51] Int. Cl.[5] ..... G03C 1/485; G03C 1/10

[52] U.S. Cl. ..... 430/596; 430/597; 430/598; 430/600; 430/603; 430/411; 430/412

[58] Field of Search ..... 430/596, 597, 598, 600, 430/603, 411, 412

[56] References Cited

U.S. PATENT DOCUMENTS

| | | | |
|---|---|---|---|
| 4,221,863 | 9/1980 | Overman et al. | 430/567 |
| 4,770,991 | 9/1988 | Kojima et al. | 430/611 |
| 4,857,445 | 8/1989 | Yoshida et al. | 430/509 |

*Primary Examiner*—Paul R. Michl
*Assistant Examiner*—Janis L. Dote
*Attorney, Agent, or Firm*—Jack Matalon

[57] ABSTRACT

Direct positive photographic films are disclosed having novel density enhancers of the formula

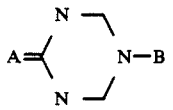

(I)

wherein A is oxygen or sulfur, and B is selected from the group consisting of hydrogen, alkyl haloalkyl, hydroxyalkyl, alkylamino and alkoxy. Photographic materials coated with emulsions having these density enhancers display good optical density while maintaining high speed capability.

20 Claims, No Drawings

DIRECT POSITIVE FILMS

BACKGROUND OF THE INVENTION

1. Field of the Invention

This invention relates to high-density direct positive film emulsions and films made therefrom. More particularly, the invention relates to film emulsions comprising a density enhancer which does not significantly reduce film speed.

2. Brief Description of the Prior Art

Direct positive film desirably displays high optical density for promoting good contrast and clarity of images produced. Numerous techniques have been employed to maximize optical density without adversely effecting other characteristics of the film. In prior art films, the exposure time necessary to produce an acceptable image tended to increase as density increased. Yet, for many applications, production of acceptable images using short exposure time is desired. There is therefore a need for producing high density direct positive film without reducing speed, i.e., without significantly increasing the time of exposure necessary to produce an acceptable image.

OBJECTS OF THE INVENTION

Accordingly, it is an object of the present invention to provide high density direct positive films capable of providing sharp images with minimal exposure time.

It is a further object of the invention to provide film emulsions which, when coated on an appropriate substrate, produce high density films which, despite their density, perform well at high speed.

It is a further object of the invention to provide film products capable, after exposure and development, of producing sharp high contrast images.

SUMMARY OF THE INVENTION

These and other objects are accomplished by providing a direct positive film emulsion comprising an amount of a density enhancer of the formula:

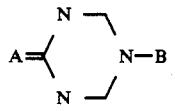

(I)

wherein A is oxygen or sulfur (preferably sulfur), and B is selected from the group consisting of hydrogen, alkyl, haloalkyl, hydroxyalkyl, alkylamino, and alkoxy (preferably hydroxyalkyl), said density enhancer being present at a concentration effective to increase optical density by at least about 0.08 relative to an analogous emulsion lacking said density enhancer. An "analogous emulsion" is one lacking said density enhancer, but having identical relative concentrations among all other components. Except for the ring substituents expressly illustrated in Structure I, other ring atoms are preferably, but not necessarily, substituted only by hydrogen atoms (not shown in Structure I).

In certain preferred embodiments, the invention provides an improved film product comprising a thin layer of the foregoing emulsion of the invention on a suitable photographic substrate.

It has surprisingly been found that a compound of structure I, when added to film emulsions in accordance with the present invention, significantly increases the optical density provided by a layer of said emulsion on an appropriate substrate. Moreover, it has been found that the addition of this compound and associated enhancement of film density does not have a significant adverse effect upon film speed.

As used herein, optical density refers to the base 10 logarithm of the quotient of the intensity of incident light on a layer of film emulsion divided by the intensity of transmitted light which penetrates the emulsion and continues to a detector on the other side. Optical density may be determined in this manner by utilization of a commercially available diffuse transmission densitometer available, for example, from Macbeth Company of Newburgh, N.Y.

All density values set forth herein are values obtainable by coating a layer of film emulsion being tested onto a 0.004 inch thick substantially transparent polyester support, wherein the support alone contributes 0.03 to the density reading.

"All bromide ion concentrations set forth herein potentiometrically as millivolts correspond linearly to molar concentrations where a reading of $-50$ mv is equivalent to $1\times10^{-2}$ moles per liter and a reading of $+65$ mv is equivalent to $1\times10^{-4}$ moles per liter.

All chloride ion concentrations set forth herein potentiometrically as millvolts correspond linearly to molar concentrations where a reading of $+46$ mv is equivalent to $1\times10^{-1}$ moles per liter and a reading of $+103$ mv is equivalent to $1\times10^{-2}$ moles per liter.

All chloride readings are made with an Orion #94-17-00 specific ion electrode. All bromide readings are made with an Orion #94-35-00 specific ion electrode. Both types of reading use an Orion #94-02-00 double junction Ag/AgCl reference electrode."

DETAILED DESCRIPTION OF CERTAIN PREFERRED EMBODIMENTS

In certain preferred embodiments of the invention, a direct positive film is prepared using a substantially transparent substrate such as polyester. Preferably, the substrate has a thickness from about 0.001 inches to about 0.010 inches, for example, about 0.004 inches. The density enhancer of the invention is incorporated into a direct positive emulsion which, other than the novel density enhancer, is prepared in a common manner known in the art. The emulsion preferably includes a protective colloid, such as a photographically inert gelatin or a water-soluble synthetic polymer.

Direct positive type crystals are prepared by known methods. For instance, crystals are prepared having a silver chloride core and silver bromide shell, doped with a heavy metal ion, such as a rhodium salt. The heavy metal dopant acts as an electron trap. Preferably, the metals are selected from Group VIII of the periodic table. The crystal is prepared, for instance, by using doped silver chloride as a seed crystal in a slow stream of bromide salt and silver nitrate. This results in the formation of a silver bromide shell. Halogen flow rate is controlled to allow substantially uniform formation of crystals. The final crystals should be washed by methods such as salt flocculation, addition of polynuclear sulfonic acids, addition of acrylic type polymers or other methods known in the art. After redispersion, the resulting emulsion is fogged by known chemical fogging techniques. Preferably, the emulsion is fogged at a temperature of between about 110° F. and about 175° F., for instance, about 140° F. Preferably, the emulsion is fogged at a pH between about 5.5 and 9.0, most preferably about 6.5.

Fogging may proceed accompanied by the addition of a noble metal salt , such as gold chloride. Common fogging agents, such as thiourea dioxide, formaldehyde, stannous salts, morpholine borane, etc. may be used. Alternatively, light may be employed for fogging or a combination of light and chemical fogging may be employed. A chemical fogging agent is preferably added at a concentration between about $1.0\times10^{-6}$ and about $1.0\times10^{-4}$ moles per mole of silver.

The emulsion of the invention preferably includes UV absorbants, hardening agents, surfactants, antistatic agents and plasticizers. Preferably, the emulsion is optically sensitized by action of one or more sensitizing dyes such as cyanine, cyanine derivatives and other polymethine dyes, which are preferably added to the emulsion shortly before the emulsion is coated onto a film substrate.

The density enhancer of the invention may be added to the emulsion at any time during preparation of the film product. Preferably, the density enhancer is added during the fogging process at a concentration of about 2 to 24 mg per mole of silver. Preferred density enhancers include, but are not limited to:

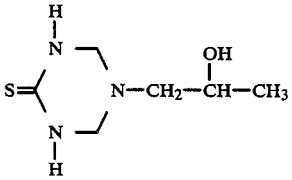

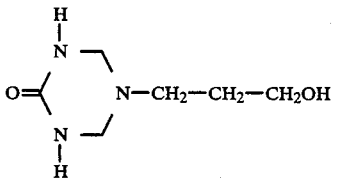

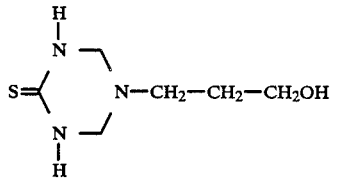

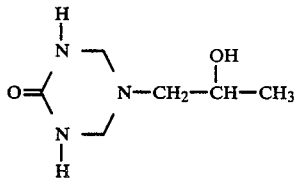

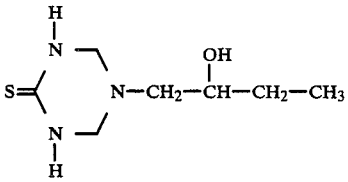

-continued

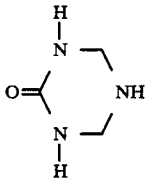

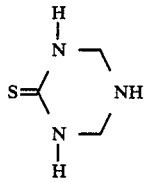

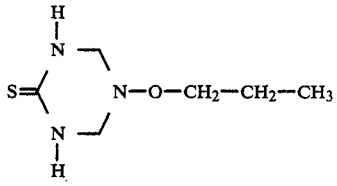

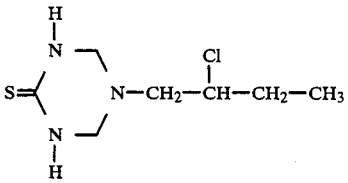

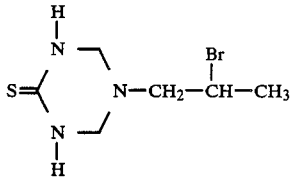

After fogging is complete, the emulsion is preferably cooled to about 100° F. and common art-recognized emulsion addenda are introduced, including, for instance, spectral sensitizing dyes, coating aids and hardeners. Appropriate hardeners include, but are not limited to, formaldehyde, other aldehydes, acid chlorides, activated halogen compounds, aziridines and epoxides. The emulsion is then coated onto the polyester or other transparent base and an overcoat of gelatin is applied. The overcoat should preferably be an aqueous gelatin solution including hardeners, surfactants and preferably matting agents. The overcoat should preferably be thin and result in a layer having between about 2 and 50 mg of solid per $dm^2$. After drying and aging, preferably for at least about one to five days at ambient or slightly elevated temperature (such as 120° F.), the film is ready for use. The film may be exposed, for instance, through a wedge and then developed using known lith, rapid access, or hybrid developers.

The invention is further illustrated by the following examples:

EXAMPLE 1

A one-mole precipitation is made having a silver chloride seed (0.06 micron), rhodium dopant, a silver chloride core, and a silver bromide shell. The final crystal is about 0.26 microns in diameter. The silver chloride core is prepared by dumping silver nitrate into a gelatin solution of potassium chloride containing rhodium ions. At 100° F., a balanced double jet core is built on the seed by contact with flowing silver nitrate and potassium chloride solutions at a constant chloride ion concentration of 75 mV (conversion to molar concentration, if desired, is defined supra) over a six minute time period. The shell is made by flowing silver nitrate and potassium bromide at a constant bromide ion concentration of 120 mV over a thirty minute period, still at a temperature of 100° F. The pH throughout all steps is maintained at about 1.6. After washing the crystals, the emulsion is redispersed and reconstituted with about 50 g of gelatin.

The emulsion is held at 100° F. and sufficient potassium iodide is added to adjust the bromide concentration to between −10 and −25 mV. Fifteen minutes of stiring follows, after which bromide concentration is adjusted to 5 mV by the addition of a sufficient amount of a dilute silver nitrate solution which effectively lowers the bromide concentration. The emulsion is then stirred for 15 minutes, the pH is adjusted to about 6.5 and temperature is raised to about 140° F. Thiourea dioxide (27.6 g of $6.7\times10^{-4}$M solution) is added, and five minutes later, gold (21.6 g of $1\times10^{-4}$M $Au^{+3}$) is added. After fifteen minutes, an orthochromatic optical sensitizer is introduced and fogging is allowed to proceed for an additional forty minutes. A density enhancer of the invention, such as 1- (2 hydroxypropyl)-4-thionoperhydro-1,3,5-triazine ("HPT") is preferably added about twenty minutes after the optical sensitizer. Upon cooling to 100° F., bulking gelatin solution, surfactant, and hardener may be added. The emulsion pH is adjusted to about 6.5 and bromide concentration is adjusted to about 60 mV. The emulsion is then coated onto a substrate and overcoated.

EXAMPLES 2-7

Six exemplary films (Examples 2-7 below) were prepared in accordance with the procedures of Example 1. The emulsions were coated onto the substrate at a silver weight of 35 mg of silver per $dm^2$. The thiourea solution is $6.7\times10^{-4}$M thiourea and gold is $1.0\times10^{-4}$M AU+3. The examples included varying amounts of density enhancer (as indicated) and either an aerosol type surfactant (aerosol OT available from American Cyanamid) or Saponin. The ion concentrations set forth in millivolts may, if desired, be converted to molar concentrations in accordance with the definition set forth supra.

| Example | g of 1.2 N KI Added to Adjust Br Conc. | Bromide Conc. After KI Addition | Bromide Conc. Aft $AgNO_3$ Added | g. Thiourea Soln/g gold Soln per Mole Silver | mg HPT per Mole Silver | Surfactant |
|---|---|---|---|---|---|---|
| 2 | 70 | −21 mV | +5 mV | 27.6 g/21.6 g | 0 | Saponin |
| 3 | 70 | −19 mV | +5 mV | 27.6 g/21.6 g | 0 | Aerosol OT |
| 4 | 70 | −17 mV | +5 mV | 27.6 g/21.6 g | 8 | Saponin |
| 5 | 70 | −16 mV | +5 mV | 27.6 g/21.6 g | 8 | Aerosol CT |
| 6 | 70 | −13 mV | +5 mV | 27.6 g/21.6 g | 16 | Saponin |
| 7 | 70 | −10 mV | +5 mV | 27.6 g/21.6 g | 16 | Aerosol OT |

Films 2 through 7 were compared under a variety of conditions for both speed and density. Several samples of each film were aged for three days, some at ambient temperatures and some in an oven at 120° F. Each film was then exposed and developed either in PC 127, a commercially available rapid access developer (Polychrome Corp., Yonkers, N.Y.) or CLBD, a commercially available lith developer (Dupont). The relative performance of different films are tabulated below in Table 1 which should be read in accordance with the following explanation:

Column 1 notes the two films being compared. A positive sign in connection with numerical values given in the body of the Table indicates that the second of the two films (the one to the right of "VS." in column 1) has performed best, i.e., has shown greater speed or greater density. A negative sign indicates that the first of the two has performed best. The values reported under columns headed "Speed.1" represent the difference between the two films being compared in the natural logarithm of their time of exposure necessary to reach a density of 0.1 above base plus fog. Values given in columns headed by the notation "DMAX" represent the difference between the two films being compared regarding their respective maximum densities, i.e., their density at unexposed portions of the film. Density values, as defined earlier, are base 10 logarithmic values. The first pair of speed and density columns denoted "PC 127 NAT" report comparative results of two films aged at ambient temperature for 3 days and, after exposure, developed with PC 127. The second pair of speed and density columns denoted "PC 127 Oven" report comparative results of two films aged 3 days in an oven at 120° F. and, after exposure, developed in PC 127. The third pair of speed and density columns denoted "CLBD NAT" report comparative data for film aged 3 days under ambient conditions and, after exposure, developed in the lith developer, CLBD. The final pair of speed and density columns denoted "CLBD OVEN" report comparative data for films aged for three days in an oven at 120° F. and, after exposure, developed in the lith developer, CLBD.

As an example of how the data reported in Table 1 should be interpreted, the following observations may be made for the relative performance of films 2 and 4 when aged under ambient conditions and, after exposure, developed in PC 127. First, the value "−0.10" in the "Speed.1" column indicates that the speed of film 4 is very slightly slower than the speed for film 2, and that the difference in the natural logarithm of the exposure time necessary to reach a density of 0.1 above base plus fog is only 0 10. The value "+0.85" in the "DMAX" column indicates that the maximum density in unexposed portions of film 4 exceed the corresponding maximum density in the unexposed portions of film 2 by a very sizeable 0.85. Analagous data comparing the same two films are reported horizontally across the same row for different aging and/or different developing conditions. Other rows report the same data when different films are being compared.

TABLE 1

| COMPARISON | WHAT COMPARING | PC127 NAT. | | PC 127 OVEN | | CLBD NAT. | | CLBD OVEN | |
|---|---|---|---|---|---|---|---|---|---|
| | | SPEED.1 | DMAX | SPEED.1 | DMAX | SPEED.1 | DMAX | SPEED.1 | DMAX |
| 2 vs. 4 | 0 to 8 mg HPT, (Saponin) | −.10 | +.85 | −.05 | +.76 | −.11 | +.46 | −.08 | +1.03 |
| 3 vs. 5 | 0 to 8 mg HPT, (Aerosol OT) | −.03 | +.56 | −.02 | +.03 | −.04 | +.31 | +.04 | +1.12 |
| 2 vs. 6 | 0 to 16 mg HPT, (Saponin) | −.12 | +1.22 | −.09 | +.76 | −.15 | +.58 | −.14 | +1.79 |
| 3 vs. 7 | 0 to 16 mg HPT, (Aerosol OT) | −.03 | +.71 | −.04 | +.08 | −.11 | +.24 | −.06 | +1.92 |

It is evident from the data reported above that, under a wide variety of conditions, a density enhancer in accordance with the invention significantly increases density with minimal adverse affect on speed. Both speed and density are affected to a somewhat lesser extent by the surfactant chosen, and data regarding these effects are set forth below in Table 2.

TABLE 2

| COMPARISON | WHAT COMPARING | PC127 NAT. | | PC 127 OVEN | | CLBD NAT. | | CLBD OVEN | |
|---|---|---|---|---|---|---|---|---|---|
| | | SPEED.1 | DMAX | SPEED.1 | DMAX | SPEED.1 | DMAX | SPEED.1 | DMAX |
| 2 vs. 3 | Saponin vs. Aerosol OT, no HPT | −.08 | +.59 | — | +.74 | −.02 | −.05 | −.07 | −.14 |
| 4 vs. 5 | Saponin vs., Aerosol OT, 8 mg HPT | −.01 | +.30 | +.03 | +.01 | +.05 | −.32 | +.05 | −.05 |
| 6 vs. 7 | Saponin vs., Aerosol OT, 16 mg HPT | +.01 | +.08 | +.05 | +.06 | +.02 | −.39 | +.01 | −.01 |

The terms and descriptions used herein are preferred embodiments set forth by way of illustration only, and are not intended as limitations on the many variations which those of skill in the art will recognize to be possible in practicing the present invention as defined by the following claims.

What is claimed is:

1. A direct positive film emulsion comprising fogged silver halide grains and a density enhancer of the formula:

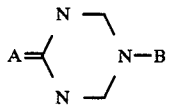

wherein A is oxygen or sulfur, and B is selected from the group consisting of of hydrogen, alkyl, haloalkyl, hydroxyalkyl, alkylamino, and alkoxy, said density enhancer having been added during the fogging of said halide grains and remaining in said emulsion at a concentration effective to increase optical density by at least about 0.08 relative to an analogous emulsion lacking said density enhancer.

2. The emulsion according to claim 1, wherein said density enhancer is present at a concentration between about 2 and 24 mg per mole of silver in said emulsion.

3. The emulsion according to claim 1, wherein said density enhancer comprises 1-(2 hydroxypropyl)-4-thiono-perhydro-1,3,5-triazine.

4. The emulsion according to claim 1, wherein said emulsion further comprises silver halide crystals having a silver chloride core and silver bromide shell.

5. The emulsion according to claim 4, wherein said silver halide crystals further comprise a heavy metal dopant.

6. A direct positive photographic image-forming material comprising a substantially transparent substrate having coated thereon a layer of a film emulsion comprising fogged silver halide grains and a density enhancer of the formula:

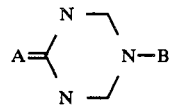

wherein A is oxygen or sulfur, and B is selected from the group consisting of hydrogen, alkyl, haloalkyl, hydroxyalkyl, alkylamino, and alkoxy, said density enhancer having been added during the fogging of said silver halide grains and remaining in said emulsion at a concentration sufficient to increase optical density by at least about 0.08 relative to an analogous emulsion lacking said density enhancer.

7. The photographic material according to claim 6, wherein the thickness of said substrate is between about 0.001 and 0.010 inches.

8. The photographic material according to claim 7, wherein the thickness of said substrate is about 0.004 inches.

9. The photographic material according to claim 6, wherein said substrate comprises a material selected from the group consisting of polyester, cellulose triacetate and polystyrene.

10. The photographic material according to claim 6, wherein said density enhancer is present at a concentration between about 2 and 24 mg per mol of silver in said emulsion.

11. The photographic material according to claim 6, wherein said density enhancer comprises 1-(2 hydroxypropyl)-4-thiono-perhydro-1,3,5-triazine.

12. The photographic material according to claim 6, wherein said emulsion further comprises silver halide crystals having a silver chloride core and silver bromide shell.

13. The photographic material according to claim 12, wherein said silver halide crystals further comprise a heavy metal dopant.

14. A direct positive photographic imageforming material comprising a polyester substrate having a thickness between about 0.001 and about 0.010 inches and having coated thereon a direct positive film emulsion comprising an amount of a hydroxypropylthionoperhydro-triazine (HPT) effective to increase optical density by at least about 0.08 relative to an analogous composition lacking said HPT, said emulsion further comprising silver halide crystals which include a heavy metal dopant.

15. The photographic material according to claim 14, wherein said HPT is 1-(2 hydroxypropyl)-4-thiono-perhydro-1, 3, 5 triazine.

16. The film emulsion of claim 1 wherein A is sulfur.

17. The film emulsion of claim 1 wherein B is a hydroxyalkyl substituent.

18. The image forming material of claim 6 wherein A is sulfur.

19. The image forming material of claim 6 wherein B is a hydroxyalkyl substituent.

20. The image forming material of claim 6 wherein A is sulfur and B is a hydroxyalkyl substituent.

* * * * *